US005972591A

United States Patent [19]

Yarmey et al.

[11] Patent Number: 5,972,591

[45] Date of Patent: Oct. 26, 1999

[54] THICKENER FOR DELIVERY OF PHOTOGRAPHIC EMULSIONS

[75] Inventors: Marianne Yarmey, Amhurst, Mass.; Wayne Arthur Bowman, Walworth, N.Y.; Stephen Joseph Kozak, Webster, N.Y.; Gary Francis Mitchell, Rochester, N.Y.; Glenn Thomas Pearce, Fairport, N.Y.; Melvin David Sterman, Pittsford, N.Y.

[73] Assignee: Eastman Kodak Company, Rochester, N.Y.

[21] Appl. No.: 08/179,830

[22] Filed: Dec. 30, 1993

Related U.S. Application Data

[63] Continuation of application No. 07/630,697, Dec. 20, 1990, abandoned.

[51] Int. Cl.[6] ..... G03C 1/015; G03C 1/38

[52] U.S. Cl. ..... 430/631; 430/628; 430/634; 430/636; 430/935; 430/402; 430/420

[58] Field of Search ..... 430/631, 935, 430/634, 636, 642, 621, 628, 620; 427/420, 402

[56] References Cited

U.S. PATENT DOCUMENTS

| | | | |
|---|---|---|---|
| 779,777 | 1/1905 | Gaedicke . | |
| 2,618,556 | 11/1952 | Hewitson et al. . | |
| 2,678,883 | 5/1954 | Jones et al. . | |
| 2,761,791 | 9/1956 | Russell . | |
| 3,153,593 | 10/1964 | DePauw . | |
| 3,582,339 | 6/1971 | Martens et al. . | |
| 3,632,374 | 1/1972 | Greiller . | |
| 3,687,707 | 8/1972 | Graham . | |
| 3,767,410 | 10/1973 | Brust et al. . | |
| 3,811,897 | 5/1974 | Babbit et al. . | |
| 3,867,901 | 2/1975 | Greiller . | |
| 3,926,869 | 12/1975 | Horie et al. . | |
| 4,113,903 | 9/1978 | Choinski . | |
| 4,166,050 | 8/1979 | Miyazako et al. . | |
| 4,224,403 | 9/1980 | Toda et al. . | |
| 4,368,258 | 1/1983 | Fujiwhara et al. | 430/631 |
| 4,388,402 | 6/1983 | Mukunoki et al. . | |
| 4,424,273 | 1/1984 | Franco et al. . | |
| 4,525,392 | 6/1985 | Ishizaki et al. . | |
| 4,569,863 | 2/1986 | Koepke et al. . | |
| 4,599,390 | 7/1986 | Fan et al. . | |
| 4,618,573 | 10/1986 | Okamura et al. . | |
| 4,751,173 | 6/1988 | Okamura et al. . | |
| 4,942,068 | 7/1990 | Schweicher et al. | 427/420 |

FOREIGN PATENT DOCUMENTS

| | | |
|---|---|---|
| 0 167 081 | 6/1985 | European Pat. Off. . |
| 0 257 515 | 3/1988 | European Pat. Off. . |
| 0 370 226 | 5/1990 | European Pat. Off. . |
| 55-56867 | 4/1980 | Japan . |
| 63-011934 | 1/1988 | Japan . |

OTHER PUBLICATIONS

Timothy W. Kao, Journal of Fluid Mechanics, vol. 33, Part 3, 1968, pp. 561–572.

A.F.M. Akhtaruzzaman et al, Journal of Applied Mechanics, vol. 45, Mar., 1978, pp. 25–31.

C.K. Wang et al, Physics of Fluids, vol. 21, Oct., 1978, pp. 1669–1673.

Research Disclosure No. 176043, Dec. 1978.

Research Disclosure No. 23406, "Viscosity–Increasing Agent For Photographic Coating Compositions", Oct. 1983, pp. 311–312.

Research Disclosure, vol. 308, Photographic Silver Halide Emulsions, Preparations, Addenda, Processing and Systems, Dec. 1989, pp. 993–1015.

Research Disclosure, No. 234, "Viscosity–Increasing Agent For Photographic Coating Compositions", Oct. 1983, pp. 311–312.

Research Disclosure No. 17643, Dec. 1978.

*Primary Examiner*—Thorl Chea

*Attorney, Agent, or Firm*—Paul A. Leipold

[57] ABSTRACT

The invention is generally accomplished by providing a photographic element and a process of its formation wherein a gelatin silver halide emulsion is provided with a thickener comprising a copolymer of the structure wherein A comprises about 10 to about 20 parts by weight of said copolymer, and B comprises about 80 to about 90 parts by weight of said copolymer.

It is particularly preferred that the copolymer be provided in a hardener layer to minimize the amount of gelatin needed and thus reduce the reaction of hardener with gelatin. The invention finds a preferred use in curtain coating wherein there is a greater need for high viscosity materials, particularly at the bottom of a group of layers in order to minimize distortions of the layers as they are applied in the curtain coating process.

1 Claim, 6 Drawing Sheets

THICKENER FOR DELIVERY OF PHOTOGRAPHIC EMULSIONS

This is a continuation of application Ser. No. 07/630,697, filed Dec. 20, 1990, now abandoned.

FIELD OF THE INVENTION

The invention relates to use of a particular thickener for coating of photographic materials. In one aspect it relates to the thickener for use in a hardener-containing layer of a photographic element.

PRIOR ART

Generally, in the photographic art there are two primary methods of coating photographic materials. One is the bead coating process. U.S. Pat No. 2,761,417—Russell et al, U.S. Pat. No. 2,681,294—Beguin, and U.S. Pat. No. 4,525,392—Ishizaki illustrate a method of simultaneously applying multiple layers of photographic materials by the bead coating process and apparatus for practicing that process. The second primary method is the curtain coating process. U.S. Pat. No. 3,632,374—Greiller and U.S. Pat. No. 4,569,863—Koepke et al illustrate apparatus and process for curtain coating. In both the curtain coating and bead coating processes, a series of layers are extruded upward onto an inclined plane and flowed downward either to drop as a curtain onto a moving belt or to be directly picked up by a moving belt. As the layers of gelatin move along the inclined plane or slide of the extrusion head, various instabilities can occur that affect the uniformity of the layers. These include waves caused by disturbances, such as hopper vibrations, delivery system pulsations, and thermal variations. The disturbance waves may be amplified and amplification generally increases as the flow rate increases, viscosity decreases, and slide length increases. Mismatches between the viscosity of various layers can cause instability and therefore flow disturbances. Any low viscosity layer or bottom layer in the layers extruded from an extrusion head may be more subject to disturbances. The wave disturbances are often particularly apparent in the bottom layer of the layers of material leaving the slide for delivery in a curtain or as a bead if this layer has a viscosity lower than the rest of the layers. In order to overcome these instabilities, it is desirable to provide a more viscous layer at the bottom of a particular group of layers being coated simultaneously. However, increasing melt viscosity by increasing gelatin content is disadvantageous as material cost is increased. Moreover a dimensionally thicker layer in the product resulting from increased gelatin content can produce more light scattering and may deteriorate photographic performance.

Viscosity enhancers have been proposed for controlling viscosity without increasing the amount of gelatin in a layer. U.S. Pat. No. 3,929,869—Horie et al discloses an acrylic acid-acrylamide copolymer utilized as a viscosity enhancer in a system containing a gelatin, viscosity enhancer, and hardener. U.S. Pat. No. 4,166,050—Miyazako et al discloses increasing the viscosity of a photographic coating solution by utilization of a polymer compound having a maleic acid content of more than 40 percent. However, the use of polymer viscosity enhancing or thickening agents has not been found to be entirely satisfactory, as they are not photographically neutral or inert enough to perform in a satisfactory manner in some photographic layers. Thus, when such viscosity enhancers have been used, it has tended to be in silver halide free layers.

The need for viscosity increase can be particularly severe in the curtain coating process particularly at high speeds. Emulsions with low gelatin content have low viscosity. The low viscosity increases the difficulty of the emulsion layers moving down the slide without formation of waves or other slide disturbances. Further, slides in curtain coaters are generally longer than in bead coating, thereby increasing the likelihood of slide instabilities. Instabilities, i.e., waves, increase in amplitude exponentially with increased slide length. Adding additional gelatin to decrease slide instabilities by increasing viscosity may lead to decreases in product quality by increasing light scattering and causing localized premature hardening that results in formation of slugs of hardened gelatin. Viscosity control in layers containing hardeners is particularly difficult as addition of gelatin to raise viscosity may lead to increased slug formation. Slugs may cause coating defects. Therefore, hardener containing layers are the most difficult to control on the slide as the addition of gelatin for viscosity increase should be avoided. Therefore, there is a need for improved viscosity enhancers or thickeners to reduce waves and other instabilities when coating layers of photographic film. When used in silver halide emulsion coating layers, these improved viscosity enhancers should be photographically inert.

The Invention

An object of the invention is to overcome disadvantages of prior processes.

Another object is to provide improved curtain coating of photographic materials.

A further object is to provide photographic products with decreased coating nonuniformities.

An additional object is to provide improved hardener delivery in photographic coatings.

A further additional object of the invention is to provide improved bead coating.

These and other objects of the invention are generally accomplished by providing a photographic element and a process of its formation wherein a gelatin silver halide emulsion is provided with a polymer viscosity enhancer comprising a copolymer of the structure

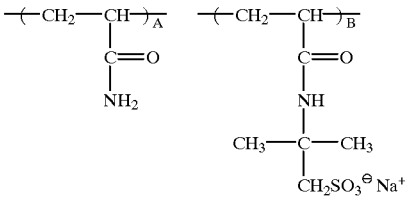

wherein

A comprises about 10 to about 20 parts by weight of said copolymer, and

B comprises about 80 to about 90 parts by weight of said copolymer.

It is particularly advantageous that the copolymer be provided in a hardener layer to reduce the amount of gelatin required, and thereby reduce the rate of reaction of hardener with gelatin. The invention also finds a preferred use at the bottom of a group of layers in order to minimize distortions of the layers as they are applied in the bead or curtain coating process.

MODES OF PERFORMING THE INVENTION

Figure 1:
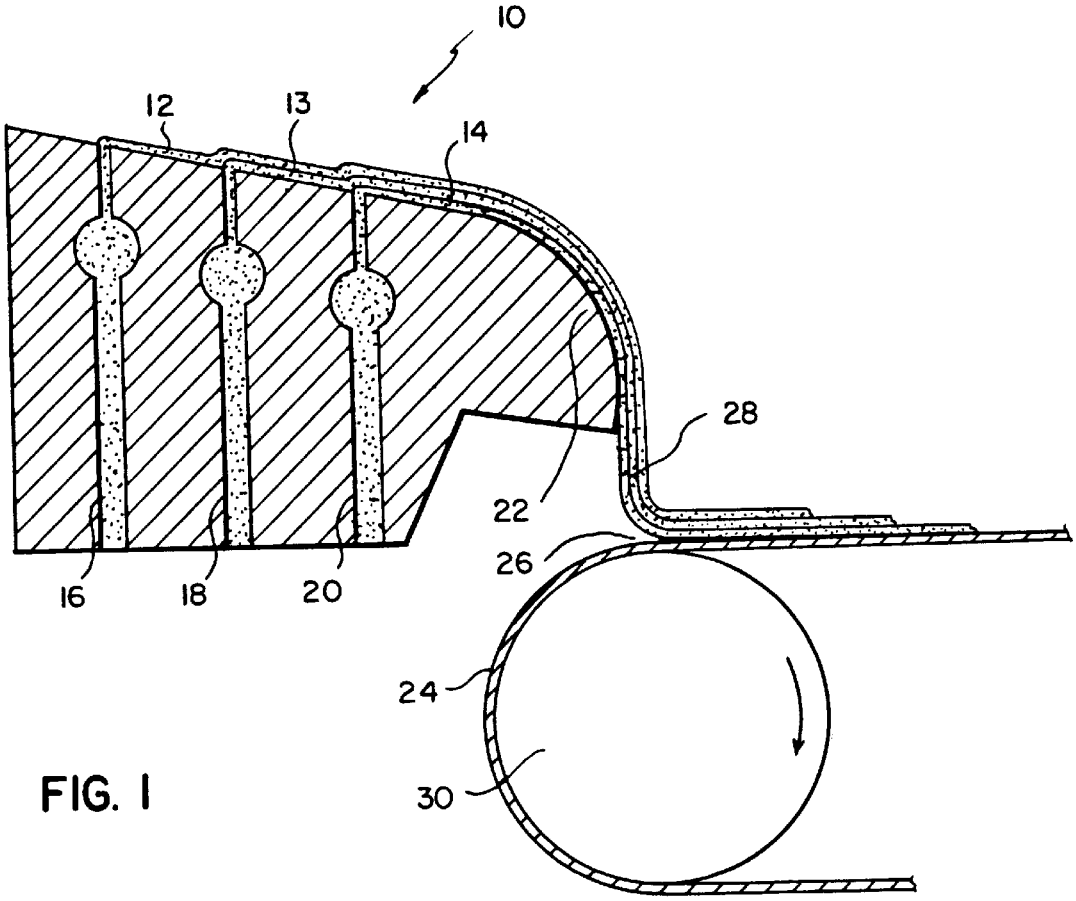
FIG. 1 illustrates a curtain coating process and apparatus.

The invention has numerous advantages over prior processes for forming photographic elements. The polymer of the invention allows thinner layers to be formed at high speeds both in bead and curtain coating. The process further allows the utilization of an increased amount of hardener at high viscosity and low gelatin loading without having excessive reaction between the hardener and gelatin in the coating hopper where any stagnant regions may permit relatively long residence times and allow premature reaction between the hardener and gelatin, leading to formation of slugs. The polymer of the invention further improves photographic properties in that light scattering caused by dimensionally thick gelatin layers is reduced. Another advantage is that the gelatin layers containing polymers of the invention provide films having fewer lines and streaks, as well as being easier to form as the window of temperature variation during coating is wider utilizing the polymer than utilizing only gelatin for viscosity control. An additional advantage is that the polymer containing gelatin emulsion coating melts of the invention are more viscous thereby minimizing waves on the slide.

The invention has further advantages over prior processes for forming photographic elements. Addition of the polymer of the invention to photographic coating fluids used in the bottom layer of a slide pack in the manner described enhances the viscosity of these fluids to allow better slide coating quality at high coating speeds and reduced flow after coating or mottle due to air impingement or support non-planarities. Careful control of the molecular weight and composition of the polymer allows this enhancement to be achieved at polymer concentrations of less than 15% of the total gelatin weight in the coated melt allowing the coated layer to maintain the beneficial mechanical properties associated with gelatin. Careful control of the molecular weight and composition allows formation of a viscosity enhanced fluid which shear thins modestly at shear rates of 100 to 3000 $sec^{-1}$ encountered in the hopper and on the slide, thereby giving better coating quality than fluids which shear thin more severely in this region. Shear on the slide generally is believed to be less than 1000 $sec^{1}$. Careful control of molecular weight and composition gives coating fluids which shear thin substantially at shear rates of 50,000 to 300,000 $sec^{-1}$ encountered near the web in bead coating. It is known that low viscosity in the bead region shows improved bead coating quality.

The fluid consisting of the polymer of the invention plus gelatin, with or without sensitized components, further allows the utilization of hardener in the coating fluids with an increase in the time required for the coating fluid to begin to harden, or form gel slugs before coating, thus making the coating fluids unusable. This time is longer compared to fluids containing only gelatin at a concentration having the same viscosity laydown as the gelatin polymer mixture and the same amount of hardener. This allows the use of the lower total amounts of solids (polymer+gelatin) to achieve needed coating viscosities, which will result in thinner coated layers. It is known in the trade that thinner layers give increased sharpness.

The viscosity requirements of the bead and curtain coating processes for high speed film coating are narrower and more stringent as speeds increase for curtain and for bead coating processes. Curtain coating may have more problems with coating discontinuities or nonuniformities because bottom layers can be thinner than for bead coating and a thinner bottom layer promotes wave discontinuities on the slide. Also the slide for curtain coating is generally longer than for bead coating. When the increased viscosities are reached by addition of gelatin to the solution, the layer becomes thick, causing light scattering which deteriorates photographic properties.

FIG. 1 illustrates curtain coating apparatus 10. As illustrated, the apparatus is forming a pack of three layers 12, 13, and 14 that are supplied from extrusion channels 16, 18, and 20 respectively. It is apparent that the bottom layer 14 is subjected to disturbances in flow as it moves over the slide and lip 22. Movement over the slide and lip may cause waves and other slide instabilities. The layers fall and contact the moving belt 24 at contact point 26. A potential problem in film formation is air entrapment at the contact point with the belt. Belt 24 rides on turning roll 30 and carries bottom layer 14. The middle layer 13 and top layer 12 are on layer 14 for much of the travel and do not contact the belt. While the apparatus 10 only is illustrated as forming a pack of three layers, it is known in commercial processes to form much thicker packs of four, five, six, or more layers. The falling of the curtain at 28 is followed by the abrupt change in direction at 26 as the curtain 28 contacts belt 24.

Figure 2:
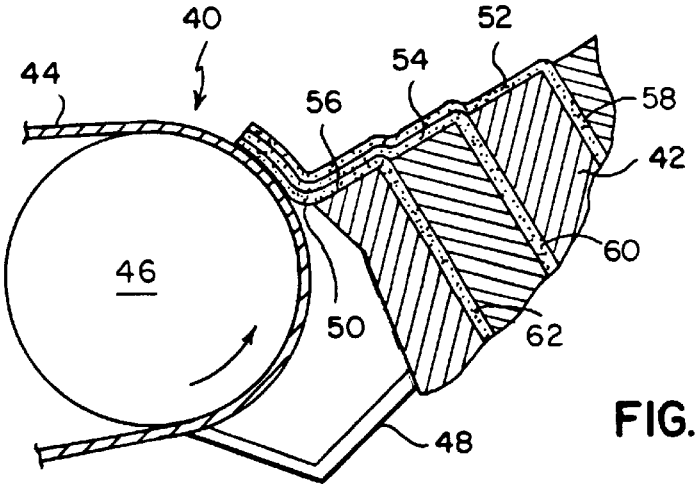
FIG. 2 illustrates a bead coating process and apparatus.

FIG. 2 illustrates a bead coating apparatus 40 that is composed of a slide coater 42 and belt 44 onto which the photographic material is coated. Belt 44 is turned on drum 46. The apparatus further is provided with a vacuum chamber 48 situated below the bead area 50. The slide is illustrated as casting three coats 52, 54, and 56 from extrusion channels 58, 60, and 62 respectively. It is apparent that in the bead coating process the lower layer also is subjected to the greatest distortion forces at the bead area. Shear thinning at the high shear rates in the bead aids in coating. Vacuum chamber 48 serves to aid in transfer of the bead from the slide to the belt in a uniform manner.

As indicated above, the polymer composition of the invention comprises a copolymer having the structure

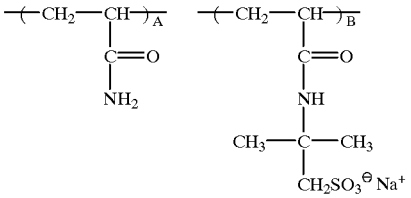

wherein

A comprises about 10 to about 20 parts by weight of said copolymer, and

B comprises about 80 to about 90 parts by weight of said copolymer.

The most preferred composition is about 20 parts by weight of A and about 80 parts by weight of B monomer to form the copolymer for good viscosity control. This is most particularly preferred for low gelatin levels in photographic emulsions where greater viscosity is required.

The hardeners utilized with the polymer of the invention may be any hardener that is desirably employed in the particular photographic element being formed. The polymer is suitable for use with both conventional and fast-acting hardeners. Typical of such hardeners are those disclosed in *Research Disclosure* 17643, Dec., 1978. A suitable hardener comprises bis-(vinylsulfonylmethyl)ether (BVSME). The invention polymers have been found to be particularly suitable for utilization with the hardener, bis-(vinyl sulfonyl) methane (BVSM) hardener, as the polymer does not react with the hardener and gives good viscosity control. The polymer of the invention is found to be particularly suitable for photographic use as it is generally inert at the specified loadings and does not react either with the gelatin hardeners or with photographic couplers or addenda with which it comes into contact during formation of photographic elements.

Figure 3:
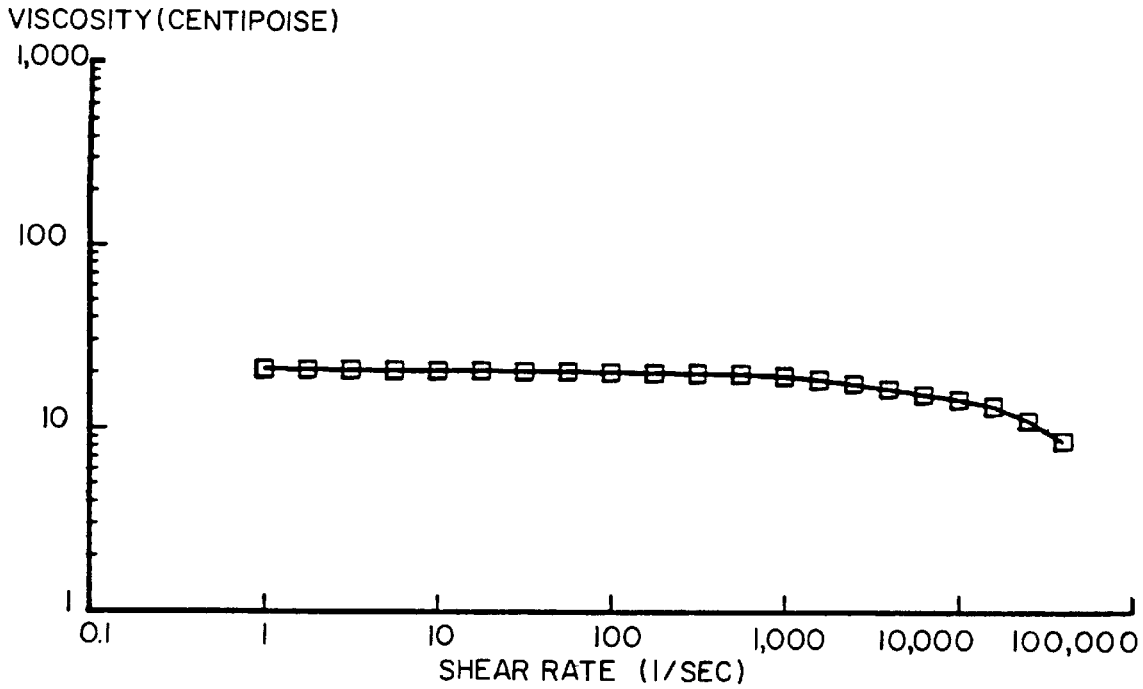
FIGS. 3 and 4 compare shear thinning properties of invention and non-invention polymers.
Figure 4:
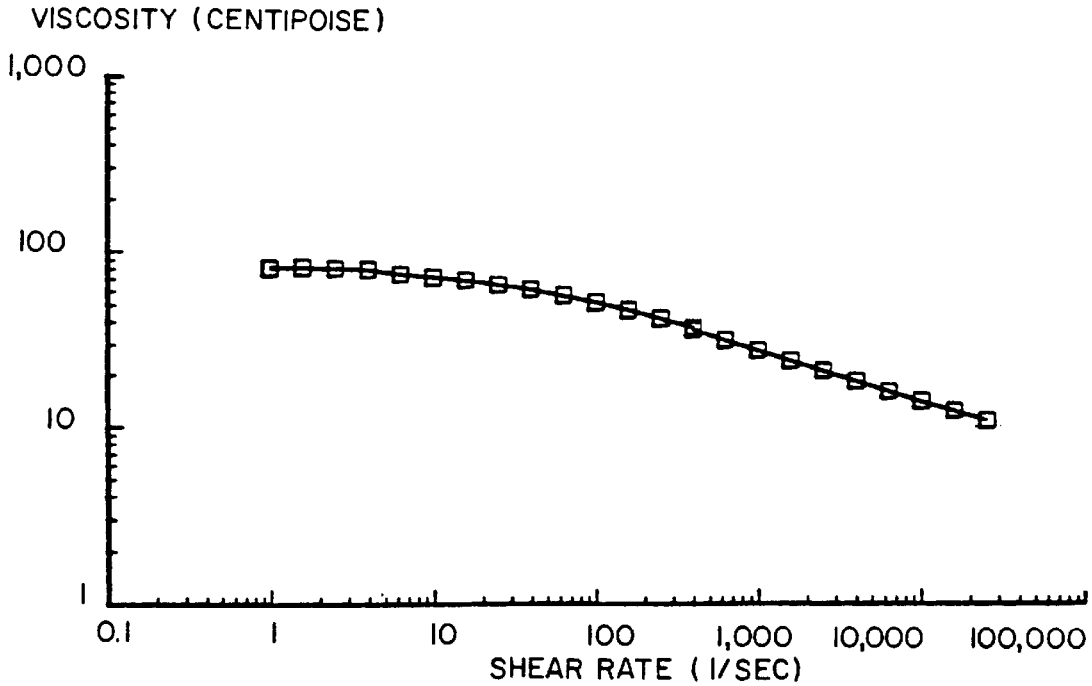

It is theorized that the polymer of the invention is effective in viscosity control for curtain coating and bead coating because the polymer when mixed in gelatin water solution provides a rheological profile that is not significantly shear thinning at shear rates of up to about 1,000 reciprocal seconds. A rheological profile is a plot of viscosity versus rate of shearing. It has been found that normal coating conditions on the slide of a curtain coating or bead coating process are between about 100 and 1,000 reciprocal seconds shear rate. Most polymer (thickener), gelatin, and water systems are shear thinning at shear rates significantly below 1,000 reciprocal seconds. This thinning as such shear forces are applied on the slide results in a lower effective viscosity which favors instabilities. The instabilities may result in uneven flow causing waves or other nonuniformities in the product. In contrast, the polymer, gelatin, and water systems of the invention will maintain uniform viscosity over the entire range of shear conditions on the slide in bead and curtain coating. They therefore will flow evenly, although shear rates may differ across the width of the extruded coatings on the slide. Illustrated in FIG. 3 is a plot of viscosity vs. shear rate of the AB20/80 polymer of the invention mixed with gelatin illustrating the uniform viscosity below 1,000 reciprocal seconds. In contrast, FIG. 4 illustrates the rheological profile of a 100% B polymer illustrating the change in viscosity with increasing shear rate from 10 to 1,000 $sec^{-1}$. The polymer, gelatin, and water systems of both FIGS. 3 and 4 contain the same yellow coupler.

In bead coating processes utilizing the polymer thickener of the invention, the viscosity is adjusted to whatever is required for best performance of the particular layer in which it is used during coating. It is preferred that the viscosity for the bottom layer in bead coating be adjusted to a viscosity of between about 5 centipoise (cps) and about 25 cps at 40° C. for best performance when utilized with a hardener and yellow coupler for the yellow layer emulsion. A further advantage is that the polymer containing emulsions can be shear thinning at some loadings and high rates of shearing, and the lower viscosity at the bead results in less air entrapment and improved coating uniformity. The higher loadings of polymer are significantly shear thinning at high rates of shearing. Lower loadings are not as significantly shear thinning, but increase viscosity much as addition of gelatin would.

Variation in viscosity between the layers on the slide for curtain or bead coating accentuates any instabilities that are transferred to the layers by disturbances of the slide or of materials on the slide. The instabilities are characterized by a high frequency wave that forms between a low viscosity bottom layer and the higher viscosity layers above it and a low frequency wave that may form at the surface. The surface wave is affected by surface tension which reduces its frequency. There is no surface tension between the layers and, therefore, the inner layer wave is free to oscillate at a higher frequency. The rheology of the layers is an important factor in determining wave formation on the slide. In best practice, all of the layers should be nearly Newtonian at shear rates encounted on the hopper slide in order to minimize the possibility of slide waves caused by different shear properties. A Newtonian solution is one that does not change in viscosity as it is subjected to shear force.

The copolymer of the invention is usefully employed in a photographic layer as a viscosity control agent with photographic emulsions containing a dye forming coupler. Typical of such couplers are the couplers disclosed in *Research Disclosure* 17643 published Dec., 1978.

The molecular weight of the copolymer of the invention may be adjusted to provide optimum performance in the specific photographic element being formed. Typically the molecular weight is between about 400,000 and about 1,000,000 as determined by the light scattering method. A preferred molecular weight has been found to be about 600,000 to about 1,000,000 for utilization in combination with a hardener. This is preferred for the reason that it provides the desired shear, viscosity, and reactivity with hardener properties.

In curtain coating processes utilizing the thickener of the invention, the copolymer of the invention is provided in any amount to achieve the viscosity which gives a desirable product. A preferred viscosity for the bottom layer has been found to be between about 10 cps and about 25 cps at 40° C. for curtain coating with good quality at a high rate of speed of a pack of between two and nine layers.

The polymer of the invention may be used in the amount which provides an effective casting emulsion with gelatin and water. The polymer typically is added in proportion to the amount of gelatin in the layer. A suitable amount has been found to be between about 3 and 20 parts by weight of the polymer per hundred parts by weight of gelatin. A preferred amount has been found to be about 8 to 12.5 parts by weight for the bottom layer for curtain coating, as this gives higher viscosity with the hardener loading desired and allows use of an amount of gelatin that will not significantly react with the hardener and is not significantly shear thinning. A preferred amount of the polymer per hundred parts of gelatin for the bottom layer in bead coating has been found to be between about 8 parts and about 12 parts by weight, as this gives the best bead coating performance.

The preferred amount of gelatin and polymer total in the casting composition is any amount that provides desired viscosity, does not react with the hardener and does not adversely interact with the silver halide emulsion, the dye forming coupler or other photographic addenda. It is preferred that to minimize reaction with the hardener that less than about 4.5% by weight gelatin be utilized with viscosity increases being achieved as needed by the addition of the polymer of the invention.

The polymer viscosity enhancer of the invention may be utilized in any photographic element. This includes both black-and-white and color films and papers. Further, the viscosity enhancer of the invention while finding its preferred use in the bottom layer of a particular pack for bead coating or curtain coating of color films may also be utilized to adjust the viscosity of other layers in the pack when thinner layers are desired or viscosity adjustment is needed to improve the uniformity of the layer in the hopper slide, by more closely matching adjacent layer viscosity.

The following examples are intended to be illustrative and not exhaustive of the process of the invention.

EXAMPLES

Example 1

Coating Profile

A three-layer coating pack was used to evaluate stability on the slide in a photographic film form apparatus. This consisted of a low viscosity bottom layer (3–10 cps), a 34 cps middle layer, and a 34 cps top layer. The total flowrate ranged from 4–12 pounds per minute per foot of width (lb/min/ft). Bottom layers consisting of 10–80% of the total flow were studied. A dispersion of carbon black in a gelatin solution was added to the middle layer in quantities appropriate for a suitable viewing density.

Disturbances

The disturbances that affected the coating system were not controlled. It was assumed that the perturbations which affected the stability of the coating on the slide included hopper vibrations and delivery system pulsations, and that they are typical of those encountered in practice.

Uniformity Detection

A non-uniformity detector (transmission densitometer) was mounted approximately 3 meters after the coating point. The detector outputs an analog signal that is proportional to coating optical density and, therefore, layer thickness. This signal was stored by an HP 3562A Dynamic Signal Analyzer and the data converted to the frequency domain by a Fourier transform.

Hopper

A five-slot hopper was used for the entire curtain coating experiment. The bottom layer was delivered from the first two slots, the middle layer from the third slot, and the top layer from the fourth and fifth slots. The standard hopper lip used in this experiment has a final slide length of 2.25 inches on the 15 degree slide surface, and 1.25 inches on a vertical face. The slide surfaces between elements were 0.75 inches in length and 15 degrees slope.

Results and Discussion

Figure 5:
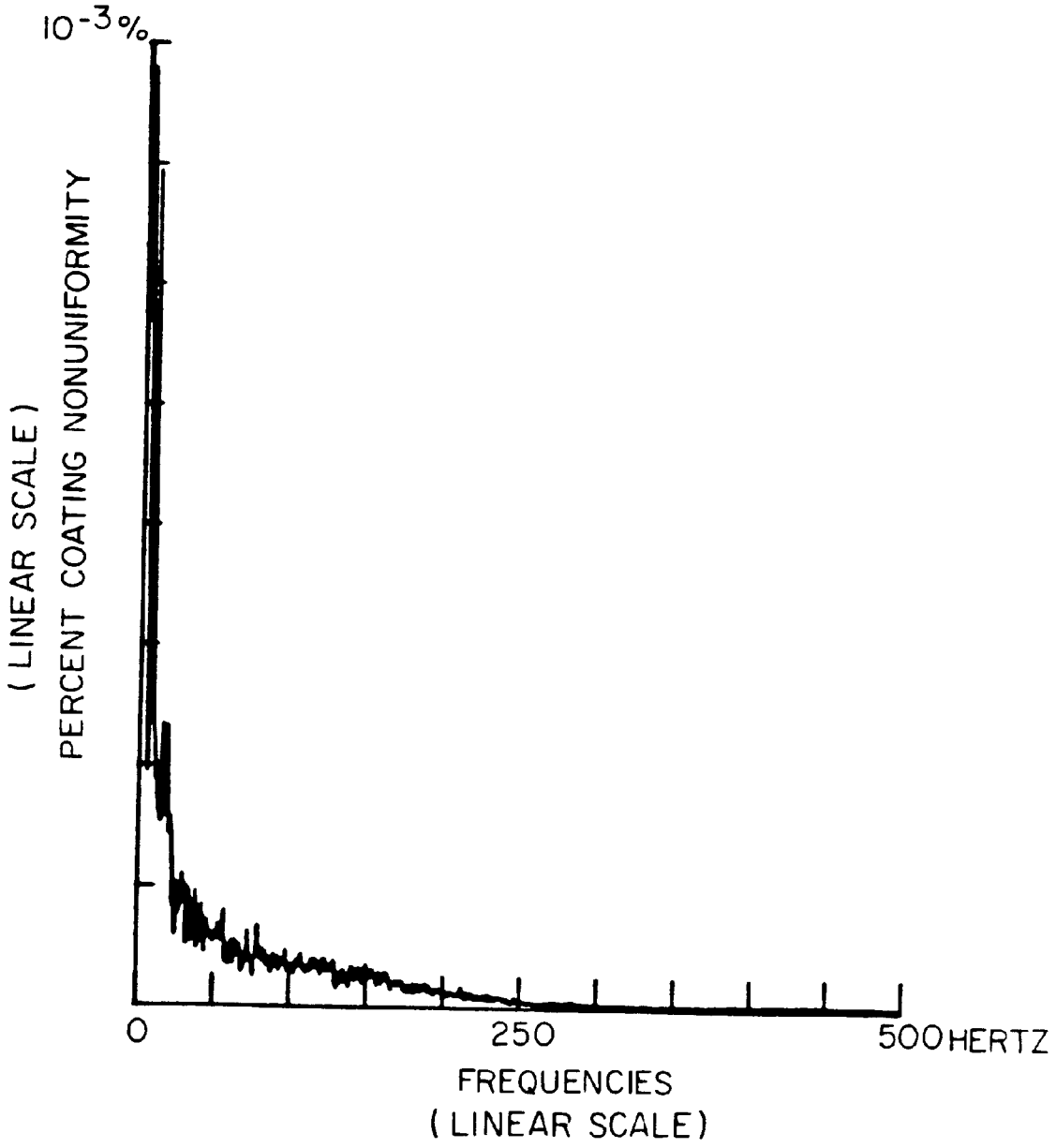
FIGS. 5–8 illustrate the examples.
Figure 6:
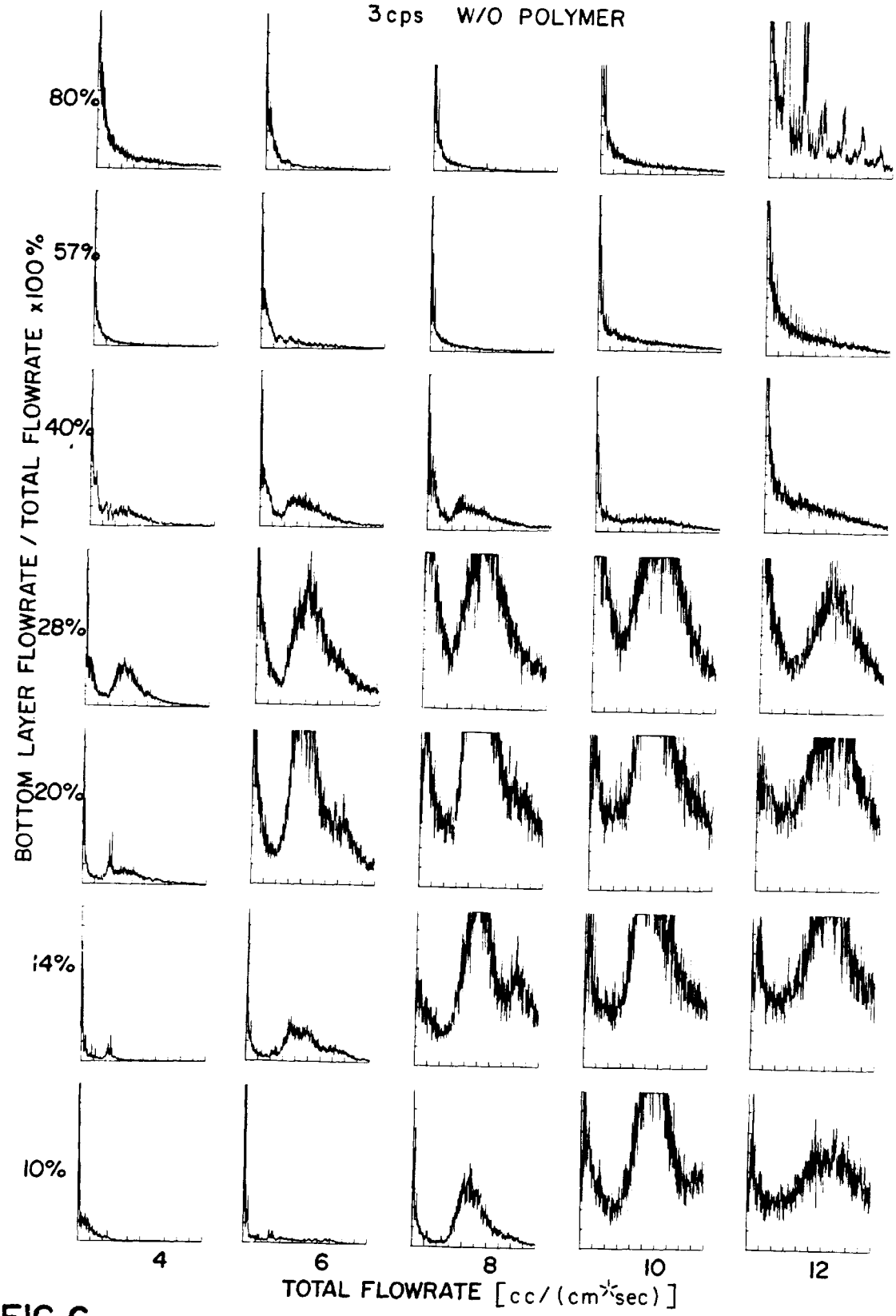
Figure 7:
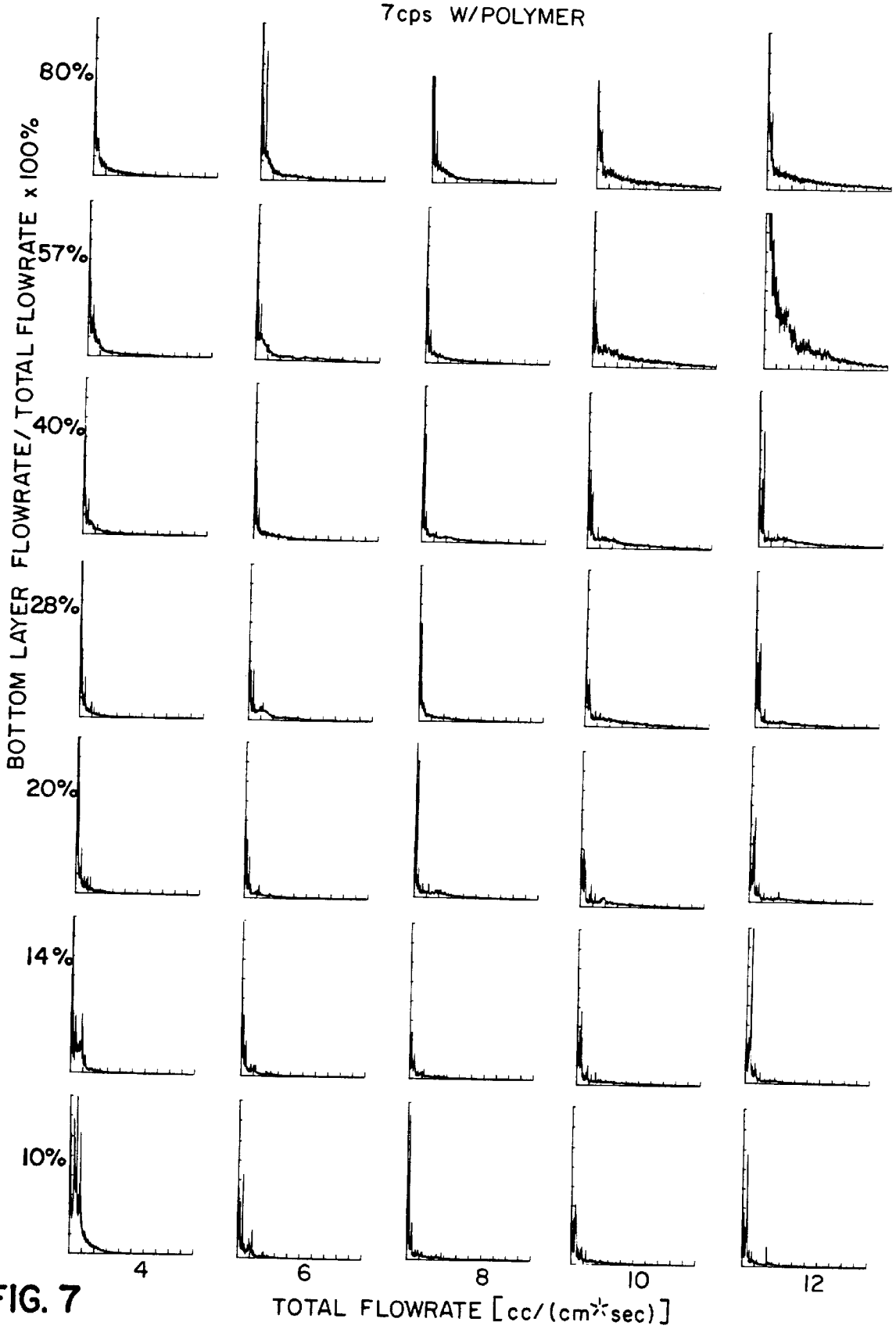
Figure 8:
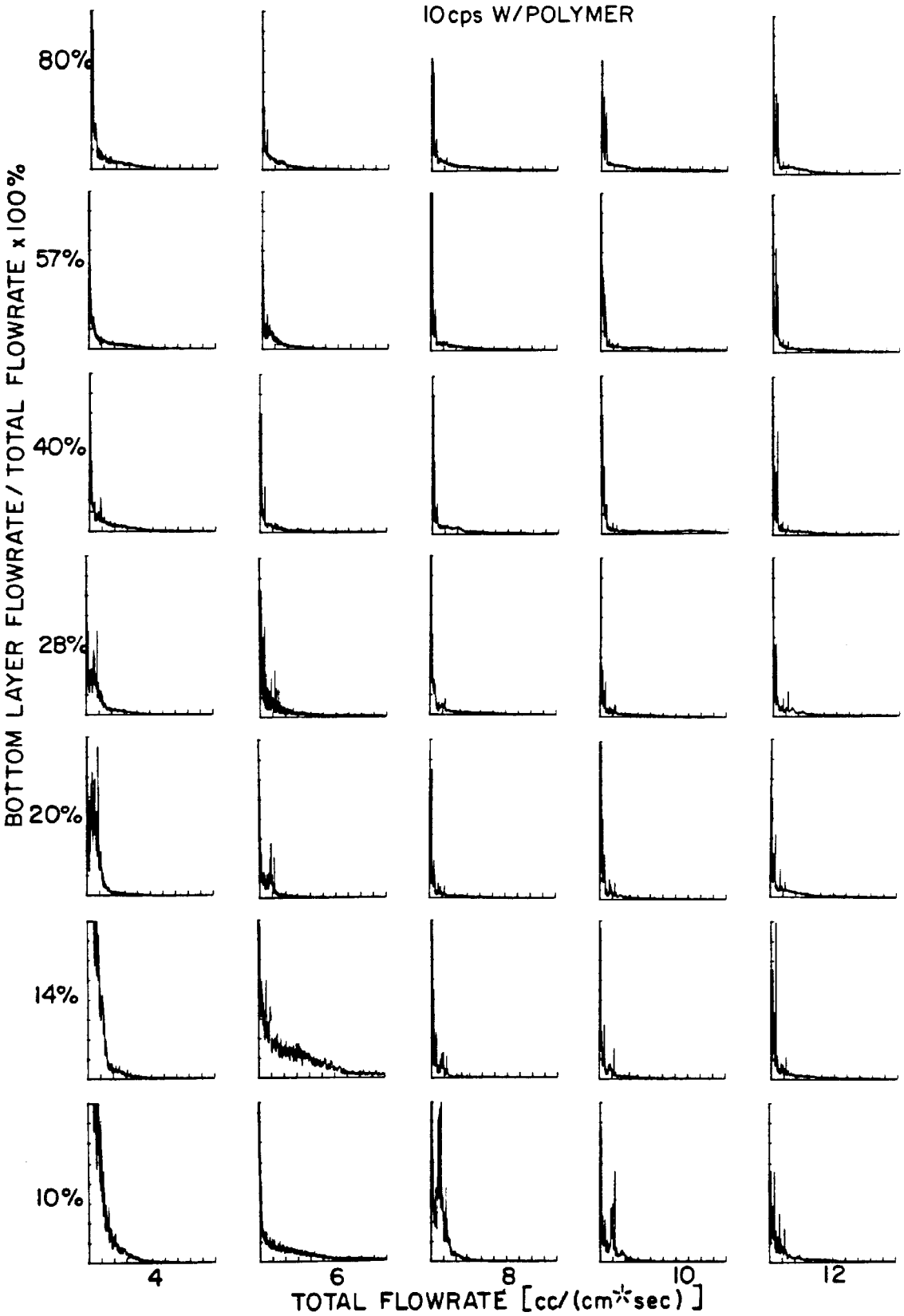

The coatings and corresponding nonuniformity versus frequency traces of the coatings are shown in FIGS. 5–8. Illustrated in FIG. 5 is an enlarged view of small graphs making up the entries in FIGS. 6, 7 and 8. In these graphs crossline frequencies from 0 to 500 Hertz are shown on the horizontal axis, and coating nonuniformity as percent nonuniformity is shown on the vertical axis. The vertical and horizontal axes are linear. FIG. 6 shows the results of coating a 3 cps bottom layer (3.8% gel) with 35 cps upper layers. FIG. 7 shows the results for a 7 cps bottom layer (3.8% gel +0.032 grams AB solids per gram gel solids). FIG. 8 shows the results for a 10 cps bottom layer (3.8% gel+0.05 AB to gel). The AB polymer was a 20 wt. percent A and 80 wt. percent B.

The coatings made with a 3 cps gel bottom layer show instabilities when the bottom layer accounts for 10 to 40% of the total flow. These instabilities are characterized by a low frequency peak (0–50 Hz) and a higher frequency peak (about 200 Hz). The low frequency peak represents the surface wave and the higher frequency peak represents the interlayer wave. As the bottom layer becomes thicker, greater than 40% of the total, the instabilities diminish. Another trend worth noting is that as the total flowrate increases, the severity of the disturbance increases. Therefore, if successful coatings are to be made at this condition, the bottom layer should account for over 40% of the total and the total flowrate should be kept as low as possible, which may contradict product and manufacturing needs.

When the invention polymer AB is added to boost the bottom layer viscosity to 7 cps, the instabilities that were present when the bottom layer was 3 cps virtually vanish. The coatings with a bottom layer viscosity of 10 cps, corresponding to the highest amount of polymer AB (0.05 g polymer solids/1 g Gel solids), also show the same benefits. Favorable results are found for increasing viscosity by adding polymers.

Example 2

The procedure of Example 1 was utilized with a polymer of 10 parts by weight A and 90 parts B substituted for the 20/80 AB polymer. This system also showed decreased waves when the polymer was added to the bottom layer to increase viscosity.

Disturbances that affect the coating are amplified as the coating flows down the slide for unstable conditions. If there were no input disturbances, there would be no nonuniformities at the end of the slide. Similarly, any increase in disturbance levels will increase the nonuniformity seen at the end of the slide. Since input disturbances can increase or decrease for a multitude of reasons, it is important that the operating conditions be relatively insensitive to them. The disturbances in this experiment, although representative of what is encountered in practice, were not controlled and, therefore, the data can only be used to compare the sensitivity of the coating conditions studied. Since input disturbances were not controlled in this experiment, the data should only be used to choose a relatively stable coating condition. The data should not be used to predict what a coating would look like if coated on another machine. The quality of coatings made will vary from machine to machine or as disturbance levels change. However, the examples clearly show the improved performance on this machine when the invention is used.

The above Examples show:

1. The AB polymer is very effective in eliminating slide instabilities caused by having a low viscosity dilute bottom layer. A reason this polymer is effective is because of its rheological profile which shows little reduction of viscosity at the rates of shearing encountered on the slide.

2. The addition of gel to a low viscosity bottom layer will increase viscosity and reduce slide related nonuniformities. This effect is also seen by the addition of polymer AB to the low viscosity bottom layer. However, the amount of gel required for a specified viscosity increase is significantly more than the amount of AB polymer required for the same increase. For this reason, addition of the AB polymer to a low viscosity bottom layer may be a more attractive option than is the addition of gel.

The invention has been described in detail with particular reference to preferred embodiments thereof, but it will be understood that variations and modifications can be effected within the spirit and scope of the invention.

We claim:

1. A process of curtain coating comprising simultaneously extruding multiple layers of photographic gelatin emulsions onto a slide wherein at least one layer coated comprises gelatin, water, and a copolymer of the structure:

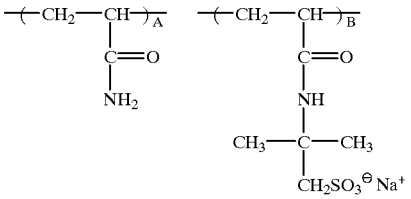

wherein

A comprises about 10 to about 20 parts by weight of said copolymer, and

B comprises about 80 to about 90 parts by weight of said copolymer, wherein the viscosity of said bottom layer is between 10 and about 25 centipoise at a temperature of about 40° C., and said bottom layer comprises about 10 to about 20 parts by weight of said copolymer per 100 parts of gelatin wherein said multiple layers comprise three or more layers and said bottom layer will maintain uniform viscosity over the entire range of shear conditions in the curtain coating.

* * * * *